United States Patent [19]

Schrameyer

[11] 3,984,880

[45] Oct. 12, 1976

[54] SPLASH GUARD AND DIVERTER FOR SHOWER CURTAINS

[76] Inventor: Arnold F. Schrameyer, Box 157, Idledale, Colo. 80453

[22] Filed: July 11, 1975

[21] Appl. No.: 595,177

[52] U.S. Cl. ..... 4/146; 4/148; 4/149; 4/154

[51] Int. Cl.[2] ..... A47K 3/22

[58] Field of Search ..... 4/145, 146, 147, 148, 4/149, 154, 153, 155; 160/349, 349 D

[56] References Cited

UNITED STATES PATENTS

| | | | |
|---|---|---|---|
| 1,807,107 | 5/1931 | Steinbergh | 4/145 |
| 3,724,000 | 4/1973 | Eakman | 4/148 |
| 3,737,921 | 6/1973 | Baumrind | 4/148 |
| 3,895,399 | 7/1975 | Giarrante | 4/149 |

*Primary Examiner*—Henry K. Artis
*Attorney, Agent, or Firm*—Horace B. Van Valkenburgh; Frank C. Lowe

[57] ABSTRACT

A web has a front or lower footing attachable to the rim of a bathtub but bending or curving to the inner edge of the bathtub rim. A second or upward footing is attachable to the wall, normally tile, above the rim of the bathtub. A round bead, for both safety and strength purposes, extends along the edge of the web from the upper edge of the upward footing to the outer edge of the lower footing, curving outwardly and downwardly from the top, then downwardly at an angle, then concavely and then convexly to the lower footing.

9 Claims, 7 Drawing Figures

SPLASH GUARD AND DIVERTER FOR SHOWER CURTAINS

This invention is a splash guard and water diverter for shower curtains associated with a bathtub.

A bathtub is ordinarily installed in a recess having the same size as the bathtub, with a wall, usually tiled, at each end of the bathtub and either extending further laterally with respect to the tub or forming a right angled corner just beyond the outside of the tub. When a shower is associated with the bathtub, a curtain rod is normally extended across the space between the walls at a position just above the shower head or outlet. A shower curtain is normally suspended by rings slidable along the curtain rod and extends to a position within the bathtub several inches below the top rim of the tub. The inside of the end wall of the tub, at both ends, normally curves inwardly to form a ledge adjacent the wall. It is extremely difficult to shift the shower curtain, so that it will contact the wall just above the ends of the tub rim. The natural inclination of the shower curtain to fall or billow away from the wall, coupled with the offset given to the edge of the shower curtain, either front or rear, by the inward curvature of the tub rim, results in a space between the shower curtain and the wall, through which water may be splashed by a person taking a shower or through which water may flow over the tub rim. This results in pools of water on the floor adjacent either or both ends of the bathtub.

Among the objects of this invention are to provide a splash guard and water diverter for one or both ends of a bathtub, specifically a bathtub which is provided with shower facilities and a shower curtain; to provide such a splash guard which may be easily mounted at one or both ends of the tub; to provide such a splash guard which eliminates to a high degree water tending to be splashed between the shower curtain and the wall; to provide such a splash guard which occupies a minimum of space at an end of the tub; to provide such a splash guard which exists in more than one form; to provide such a splash guard which may be made from a number of different materials; to provide such a splash guard which is both attractive in appearance and effective in use; and to provide such a splash guard which is readily and economically manufactured.

The attainment of the foregoing objects, as well as additional features, will become apparent from the description which follows, taken in conjunction with the accompanying drawings, in which.

Figure 1:
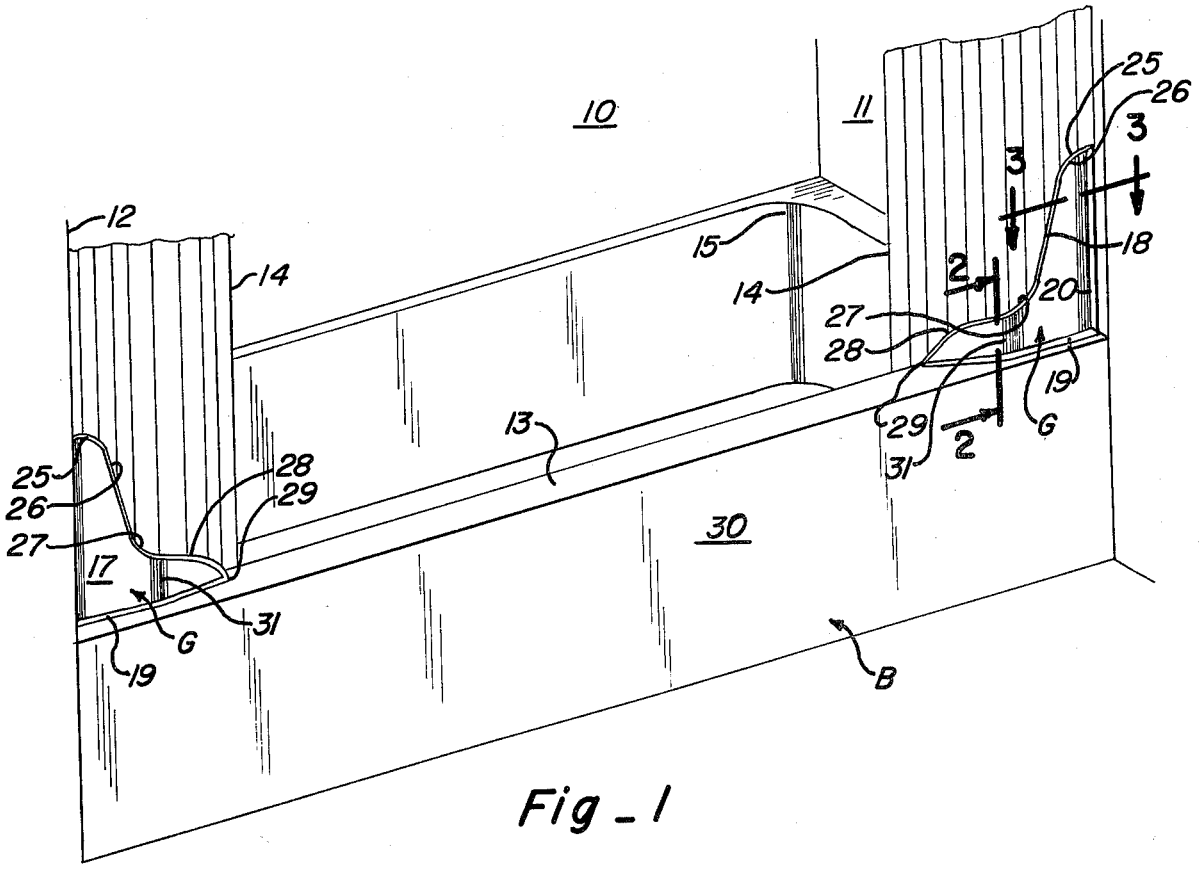
FIG. 1 is a perspective view showing both ends of a bathtub, each provided with a splash guard constructed in accordance with this invention.

As illustrated in FIG. 1, a splash guard G constructed in accordance with this invention may be mounted at each end of a bathtub B, above which are a recess wall 10 and end walls 11 and 12, the exposed surface of each of which is normally tile. The splash guards extend upwardly from the tub, being sealed to an end wall 11 or 12 and to the top 13 of the side wall of the tub. The opposite ends of the shower curtain 14 are positioned adjacent the respective walls 11 and 12, but the inward curvature 15 of the tub recess (opposite that shown) prevents the curtain from engaging the wall, although the shower curtain extends downwardly into the tub from a curtain rod, which is conventional and not shown and on which sections of the shower curtain are slidable through conventional rings. Thus, the shower curtain may be positioned against the wall at its upper edge but will still leave a gap adjacent the bathtub.

Each splash guard G is adapted to intercept streams or sprays of water which are misdirected into the space between the shower curtain and the wall 11 or 12 adjacent the bathtub, or which impinge against a wall and flow outwardly through this space. Splash guard G may have a convenient height, such as 11 or 12 inches, and may be formed, as by molding, from a suitable plastic, such as polystyrene or a medium density polyethylene. The splash guard may also be made of a translucent or a transparent plastic, but is preferably colored to add a bright touch to the decor. Or, the splash guard may be made of aluminum or other suitable metal.

The splash guards G may be identical in construction, but mirror images, and installed in facing positions. Each splash guard G may include a web 17 which has a suitable thickness, as on the order of between 1/16 inch and ⅛ inch, having an upper edge which is specially formed and surmounted by a bead 18, as on the order ot 5/16 inch in diameter, providing a rounded edge for web 17, for both reinforcing and safety purposes. A generally triangular footing 19 extends along the bottom of the web and a similar footing 20 along the upright edge, with the footing 20 normally having a slightly greater length than the footing 19. Each footing 19 and 20 may be similar in cross section, having outwardly sloping sides and an edge 21 which is generally parallel to the web, i.e. generally perpendicular to the flat bottom surface 22 of the footing, or rounded to facilitate molding. It will be understood that the sides of the footings may be planar, as shown, or curved, such as laterally concave or convex. The surface 22 is attached to the top 13 of the side wall of the bathtub, as by a suitable waterproof adhesive, while the rear surface 23 of upright footing 20 is similarly secured to the wall 11 or 12.

Figure 2:
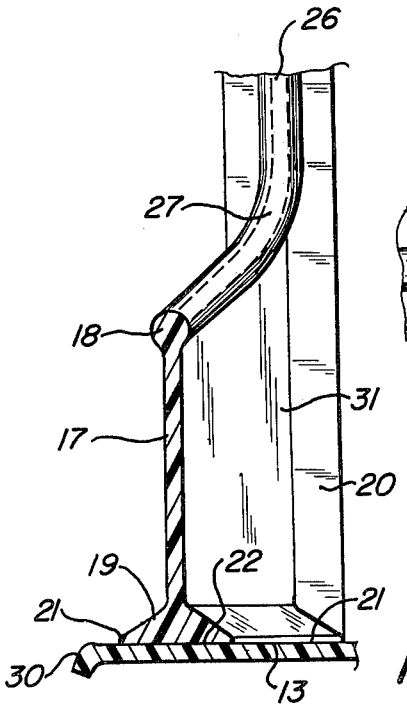
FIG. 2 is a fragmentary vertical section, on an enlarged scale and taken along line 2—2 of FIG. 1.
Figure 3:
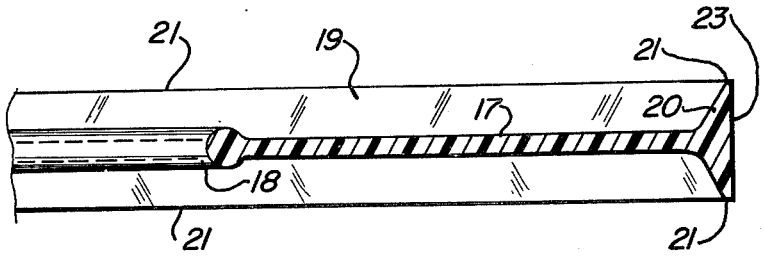
FIG. 3 is a fragmentary horizontal section, on an enlarged scale and taken along line 3—3 of FIG. 1.
Figure 4:
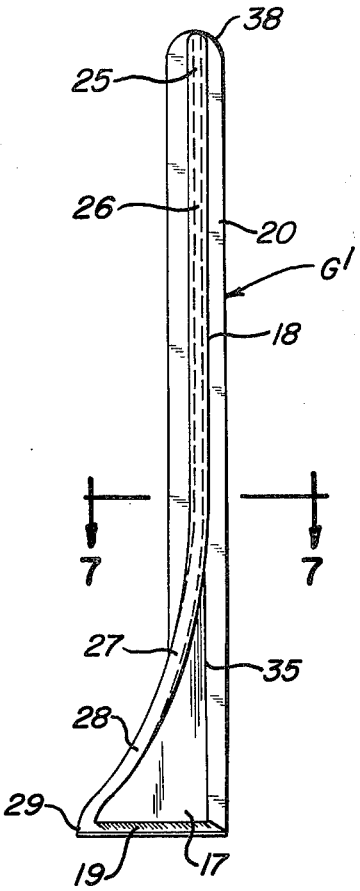
FIG. 4 is an end elevation of a splash guard constructed in accordance with this invention and forming an alternative embodiment thereof.
Figure 5:
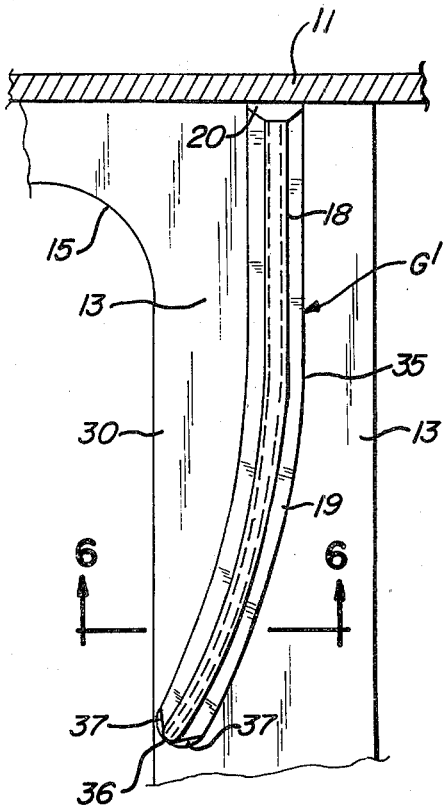
FIG. 5 is a top plan view of the splaash guard of FIG. 4, but shown as installed on the tub.
Figure 6:
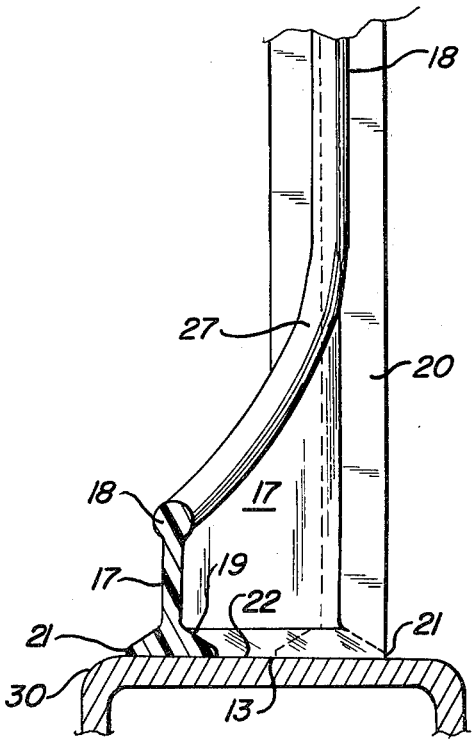
FIG. 6 is a vertical section taken along line 6—6 of FIG. 5.
Figure 7:
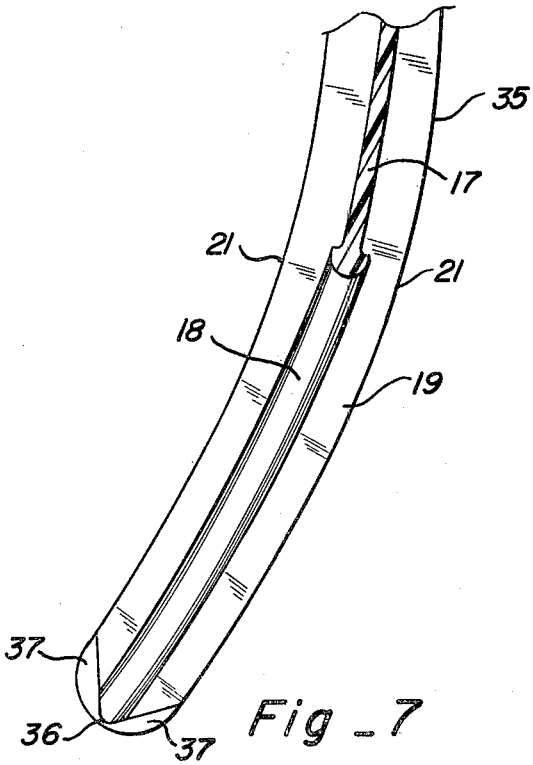
FIG. 7 is a horizontal section taken along line 7—7 of FIG. 4.

In order to provide adequate height without undue width, but still intercept and return to the tub water tending to splash or flow through the space between the curtain 14 and the wall 11 or the wall 12, the configuration of the bead 18 and upper edge of web 17 may include an upper, arcuate portion 25 which merges with a downwardly sloping portion 26 which, in turn, merges with a concave arcuate portion 27 and finally a convex arcuate portion 28, which terminates in a shallow and rounded or flat nose 29. The nose 29 of the splash guard is positioned as closely as possible to the inner edge 30 of the bathtub rim, to deflect back into the tub any water flowing along the rim top 13. In accordance with this invention, the splash guard is provided with an offset which permits the portion adjacent the wall to be spaced outwardly from the inner edge of the tub rim and the opposite end to extend to a point closely adjacent the inside edge of the rim. For this purpose, the plate 17, along with bead 18 and footing 19, is provided with a bend 31, as in FIGS. 1 and 2. This bend, which serves as the offset, may be at the concave portion 27, as shown, or at any other desired location. As will be evident, the splash guard G will intercept any water splashing or tending to flow along wall 11 to a point outside the tub, for a distance equal to the height of the splash guard. The amount of water splashed between the curtains and the wall above the splash guard is minimized by the closer position of that end of the curtain to wall 11, since the principal contribution to the space between curtain and wall is the inward curvature 15, opposite that shown in FIG. 1. Also, as water is intercepted by the splash guard, it will tend not only to flow downwardly on the splash guard, but also laterally thereof. However, the positioning of the inner edge, at nose 29, as closely as possible to the inner edge of the side wall of the bathtub, due to the bend 31, causes water flowing along the rim laterally of the splash guard to be directed back into the tub.

The splash guard G′ of FIGS. 4–7 is similar to the splash guard G, except for the transverse arcuate curvature from essentially a midpoint 35 to the free end, which serves as the offset. Thus, the splash guard G′ includes a web 17, surmounted by a bead 18 and provided with a bottom footing 19 and an upright footing 20. As before, the footings 19 and 20 are provided with sloping sides and a flat edge 21 at each side. Also, the contour of the upper edge of web 17, and consequently the contour of the bead 18, may include a convex arcuate portion, a downwardly sloping portion, a concave arcuate portion and a convex arcuate portion, each similar in shape to corresponding portions 25, 26, 27 and 28, respectively, of FIG. 1. The bead 18 and footing 19 may terminate in an angular nose 36, formed by dihedral surfaces 37, as in FIG. 7. The upper end 38, as in FIG. 4, of the upright footing 20, may be rounded to merge with bead 18. As will be evident, the extended end of the splash guard, through curving inwardly to the inner edge 30 of the top of the side wall of the tub, guides any water which may fall against the splash guard back into the tub. This obviates the possibility of water running along the top edge of the tub between the shower curtain and the splash guard, to drain out over the outer edge of the side wall of the tub and onto the floor of the bathroom.

Although two different embodiments of this invention have been illustrated and described and certain variations described, it will be understood that other embodiments may exist and that various changes may be made without departing from the spirit and scope of this invention.

What is claimed is:

1. A splash guard for a bathtub installed in a recess having a wall abutting the inner side and each end of the tub, said tub having an outer rim having a top, and a shower facility extending from one of said walls, said splash guard comprising:

a first footing constructed and arranged to extend along said tub rim in a direction away from the corresponding end wall;

a second footing constructed and arranged to extend upwardly along said end wall from said tub rim;

a web connecting said footings and having an upper edge constructed and arranged to slope generally downwardly to said tub rim; and said splash guard being adapted to be installed with the portion thereof adjacent said end wall being spaced outwardly from the inner edge of said tub rim and having an offset whereby the opposite end thereof extends to a point closely adjacent the inside edge of said rim.

2. A splash guard as defined in claim 1, wherein:

said web and lower footing are provided with a bend intermediate the ends thereof to serve as said offset and place said opposite end adjacent the inside edge of said rim.

3. A splash guard as defined in claim 1, wherein:

said web and lower footing are provided with a curve adjacent said opposite end to serve as said offset and place said opposite end adjacent the inside edge of said rim.

4. A splash guard as defined in claim 1, wherein:

said footings have edges which are spaced from and generally parallel to said web; and said footings slope from said web, on each side thereof, to said edges.

5. A splash guard as defined in claim 1, wherein:

a bead having a generally round cross section extends along the upper edge of said web, between said first and second footings.

6. A splash guard as defined in claim 1, wherein:

the upper edge of said web curves outwardly and downwardly from said second footing, then slopes downwardly at an angle, then curves concavely and then curves convexly to said first footing.

7. A splash guard as defined in claim 1, wherein:

said second footing has a slightly greater length than said first footing.

8. A splash guard as defined in claim 1, wherein:

a bead having a generally round cross section extends along the upper edge of said web, between said first and second footings;

said web, bead and lower footing are provided with a bend intermediate the ends thereof to place said opposite end adjacent the inside edge of said rim;

said bead curves outwardly and downwardly from said second footing, then slopes downwardly at an angle, then curves concavely and then curves convexly to said first footing;

said footings have edges which are spaced from and generally parallel to said web;

said footings slope from said web, on each side thereof, to said edges; and said second footing has a slightly greater length than said first footing.

9. A splash guard as defined in claim 1, wherein:

a bead having a generally round cross section extends along the upper edge of said web, between said first and second footings;

said web, bead and lower footing are provided with a curve terminating in said opposite end to place said opposite end adjacent the inside edge of said rim;

said bead curves outwardly and downwardly from said second footing, then slopes downwardly at an angle, then curves concavely and then curves convexly to said first footing;

said footings have edges which are spaced from and generally parallel to said web;

said footings slope from said web, on each side thereof, to said edges; and said second footing has a slightly greater length than said first footing.

* * * * *